US009160095B2

(12) United States Patent
Littek et al.

(10) Patent No.: US 9,160,095 B2
(45) Date of Patent: Oct. 13, 2015

(54) CONNECTOR ASSEMBLY WITH CONNECTOR POSITION ASSURANCE STABILIZER

(71) Applicant: Yazaki North America, Inc., Canton, MI (US)

(72) Inventors: James A. Littek, New Boston, MI (US); Jen Vun Ng, Westland, MI (US); Justin T. Gerwatowski, Northville, MI (US)

(73) Assignee: Yazaki North America, Inc., Canton, MI (US)

( * ) Notice: Subject to any disclaimer, the term of this patent is extended or adjusted under 35 U.S.C. 154(b) by 49 days.

(21) Appl. No.: 13/779,886

(22) Filed: Feb. 28, 2013

(65) Prior Publication Data

US 2014/0242823 A1 Aug. 28, 2014

(51) Int. Cl.
*H01R 13/422* (2006.01)

(52) U.S. Cl.
CPC ..... *H01R 13/422* (2013.01)

(58) Field of Classification Search
USPC ..... 439/168, 352, 459, 312, 489, 162, 345
See application file for complete search history.

(56) References Cited

U.S. PATENT DOCUMENTS

| | | | | |
|---|---|---|---|---|
| 5,120,255 | A * | 6/1992 | Kouda et al. | 439/489 |
| 5,605,472 | A | 2/1997 | Sakai et al. | |
| 5,643,003 | A | 7/1997 | Myer et al. | |
| 5,775,930 | A * | 7/1998 | Model et al. | 439/352 |
| 5,803,651 | A | 9/1998 | Saito | |
| 6,012,945 | A | 1/2000 | Tabor et al. | |
| 6,024,595 | A * | 2/2000 | Saba et al. | 439/489 |
| 6,068,507 | A | 5/2000 | Popa | |
| 6,126,480 | A * | 10/2000 | Kawase et al. | 439/489 |
| 6,261,116 | B1 | 7/2001 | Ceru | |
| 6,312,277 | B1 | 11/2001 | Holub | |
| 6,435,895 | B1 | 8/2002 | Fink et al. | |
| 6,461,186 | B1 | 10/2002 | Endo | |
| 6,533,601 | B2 | 3/2003 | Raudenbush et al. | |
| 6,582,243 | B2 * | 6/2003 | Endo et al. | 439/352 |
| 6,679,719 | B2 * | 1/2004 | Endo et al. | 439/352 |
| 6,716,052 | B2 | 4/2004 | Kane | |
| 6,780,045 | B2 | 8/2004 | Shuey et al. | |
| 6,824,417 | B1 * | 11/2004 | Nimura | 439/352 |
| 6,857,892 | B2 | 2/2005 | McLauchlan et al. | |
| 6,896,538 | B2 | 5/2005 | Grubbs | |
| 6,908,329 | B2 * | 6/2005 | Kozono et al. | 439/352 |
| 7,591,668 | B2 | 9/2009 | Nakamura | |
| 2004/0067676 | A1 | 4/2004 | Nimura | |

FOREIGN PATENT DOCUMENTS

| | | | |
|---|---|---|---|
| DE | 10146702 | A1 | 4/2002 |
| EP | 0788193 | A2 | 8/1997 |

OTHER PUBLICATIONS

Communication issued by the European Patent Office on May 30, 2014 enclosing the European Search Report dated May 21, 2014 for European Application No. 14157115.8 (Pub. No. EP 2772993).

* cited by examiner

*Primary Examiner* — Alexander Gilman
(74) *Attorney, Agent, or Firm* — Harness, Dickey & Pierce, P.L.C.

(57) ABSTRACT

A connector assembly having a first connector portion, a second connector portion, and connector position assurance structure. An anti-deflection tab and an anti-deflection protrusion are employed in the connector assembly to control movement of the connector position assurance structure relative to the remainder of the connector assembly.

16 Claims, 5 Drawing Sheets

CONNECTOR ASSEMBLY WITH CONNECTOR POSITION ASSURANCE STABILIZER

FIELD

The present disclosure relates to a connector assembly with a connector position assurance stabilizer.

BACKGROUND

This section provides background information related to the present disclosure which is not necessarily prior art.

Connector assemblies with connector position assurance (CPA) structures are known in the art. Such CPA structures are typically slidably coupled to a first one of a pair of mating connectors and are movable between first and second positions relative to the first connector. The CPA structure is movable into the second position only when the pair of mating connectors is fully mated. Moreover, the CPA structure is employed as a means for resisting the decoupling of the pair of mating connectors. In this regard, the pair of mating connectors typically employs mating locking tabs to resist decoupling.

Some CPA structure configurations are known to inhibit complete engagement between the mating locking tabs of the mating connectors and/or to be susceptible to the application of a deflecting force (i.e., a force directed to the CPA structure in a direction other than which results solely in axial sliding movement of the CPA structure). Accordingly, some of the known CPA structure configurations may be less resistant to inadvertent separation of the mating connectors and/or may provide a false indication to a technician that CPA structure is in a position that permits the mating connectors to be unmated. Accordingly, there remains a need in the art for a connector assembly with an improved connector position assurance structure.

SUMMARY

This section provides a general summary of the disclosure, and is not a comprehensive disclosure of its full scope or all of its features.

In one form, the present teachings provide a connector assembly that includes a first connector part, a second connector part and a connector position assurance structure. The first connector part is configured to house a first set of terminals and has a control protrusion. The second connector part is configured to house a second set of terminals and is configured to engage the first connector part in a fully engaged position in which the first and second sets of terminals are engaged to one another. The second connector part has a lock member. The connector position assurance structure is slidably mounted on the second connector part and is movable from a first position to a second position only when the second connector part is in the fully engaged position to thereby inhibit uncoupling of the first and second connector parts. The connector position assurance structure has a locking finger and a slider that is fixedly coupled to the locking finger. The locking finger has a locking tab and an anti-deflection tab. The locking tab is configured to abut a first side of the locking member on the second connector part when the connector position assurance structure is in the first position. The locking tab is configured to abut a second, opposite side of the locking member on the second connector part when the connector position assurance structure is in the second position and the second connector part is in the fully engaged position.

The control protrusion contacts the locking tab when the second connector part is in the fully engaged position and the connector position assurance structure is in the first position to urge the locking tab out of alignment with the locking member so that the connector position assurance structure can be moved to the second position. The anti-deflection tab contacts an anti-deflection protrusion on the second connector part when the connector position assurance structure is in the second position and the second connector part is in the fully engaged position to thereby inhibit disengagement of the locking tab from the lock member when the connector position assurance structure is in the second position. The locking finger is spaced apart from the control protrusion when the connector position assurance structure is in the second position and the second connector part is in the fully engaged position to permit the control protrusion to fully seat against the lock member.

In another form, the present teachings provide a connector assembly that includes a first set of terminals, a first connector part, a second set of terminals, a second connector part and a connector position assurance structure. The first connector part houses the first set of terminals and has a control protrusion. The second connector part houses the second set of terminals and is configured to engage the first connector part in a fully engaged position in which the first and second sets of terminals are engaged to one another. The second connector part has a lock member. The connector position assurance structure is slidably mounted on the second connector part and is movable from a first position to a second position only when the second connector part is in the fully engaged position to thereby inhibit uncoupling of the first and second connector parts. The connector position assurance structure has a locking finger and a slider that is fixedly coupled to the locking finger. The locking finger has a locking tab and an anti-deflection tab. The locking tab is configured to abut a first side of the locking member on the second connector part when the connector position assurance structure is in the first position. The locking tab is configured to abut a second, opposite side of the locking member on the second connector part when the connector position assurance structure is in the second position and the second connector part is in the fully engaged position. The control protrusion contacts the locking tab when the second connector part is in the fully engaged position and the connector position assurance structure is in the first position to urge the locking tab out of alignment with the locking member so that the connector position assurance structure can be moved to the second position. The anti-deflection tab contacts an anti-deflection protrusion on the second connector part when the connector position assurance structure is in the second position and the second connector part is in the fully engaged position to thereby inhibit disengagement of the locking tab from the lock member when the connector position assurance structure is in the second position. The locking finger is spaced apart from the control protrusion when the connector position assurance structure is in the second position and the second connector part is in the fully engaged position to permit the control protrusion to fully seat against the lock member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
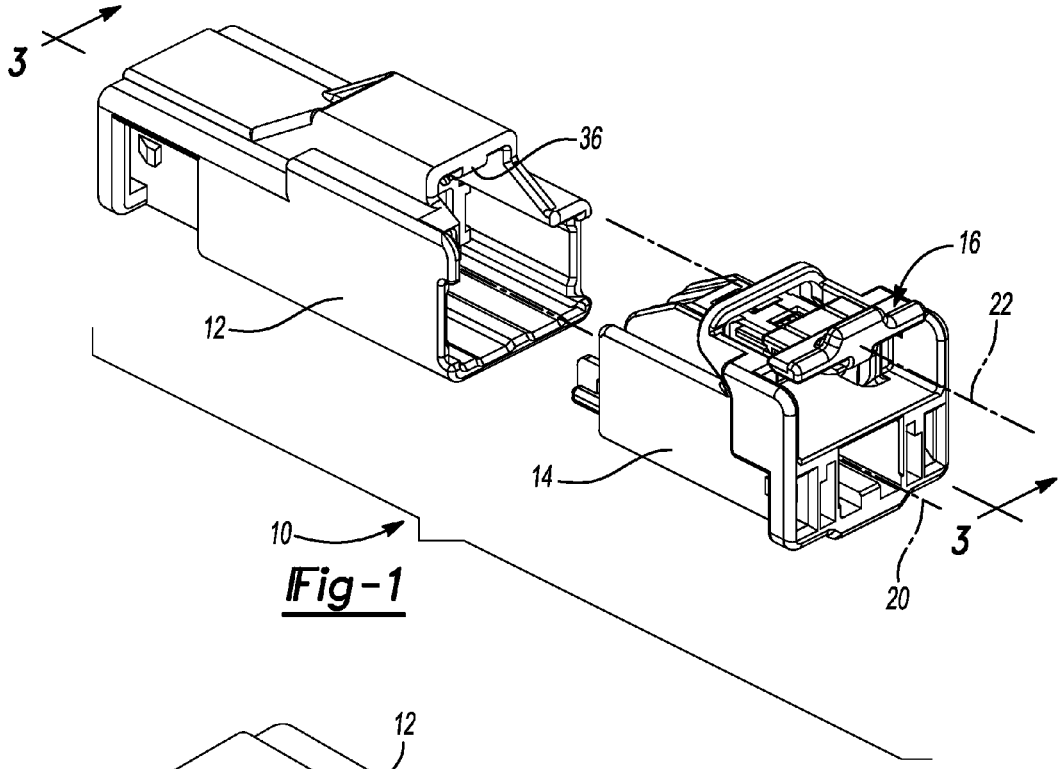
FIG. 1 is an exploded perspective view of an exemplary connector assembly constructed in accordance with the teachings of the present disclosure.
Figure 2:
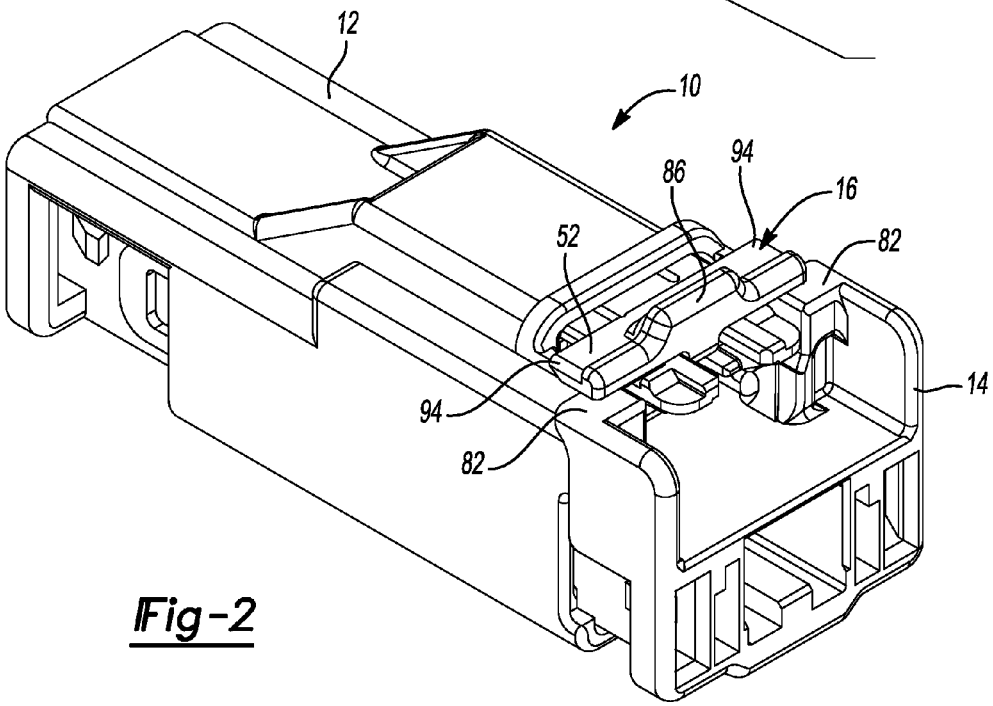
FIG. 2 is a perspective view of the connector assembly of FIG. 1 illustrating first and second connector parts in a fully engaged position and a connector position assurance structure in a second position.

With reference to FIGS. 1 and 2 of the drawings, an exemplary connector assembly constructed in accordance with the teachings of the present disclosure is generally indicated by reference numeral 10. The connector assembly 10 can include a first connector part 12, a second connector part 14 and a connector position assurance structure 16. The first and second connector parts 12 and 14 are configured to be assembled together along an insertion axis 20 such that the second connector part 14 is positioned relative to the first connector part 12 in a fully engaged position, which is shown in FIG. 2. The connector position assurance structure 16 is slidably mounted on the second connector part 14 for movement along an axis 22 that is generally parallel to the insertion axis 20 between a first position, which is shown in FIG. 1, and a second position, which is shown in FIG. 2. The connector position assurance structure 16 is movable from the first position to the second position only when the second connector part 14 is in the fully engaged position relative to the first connector part 12 to thereby inhibit uncoupling of the first and second connector parts 12 and 14.

Figure 3:
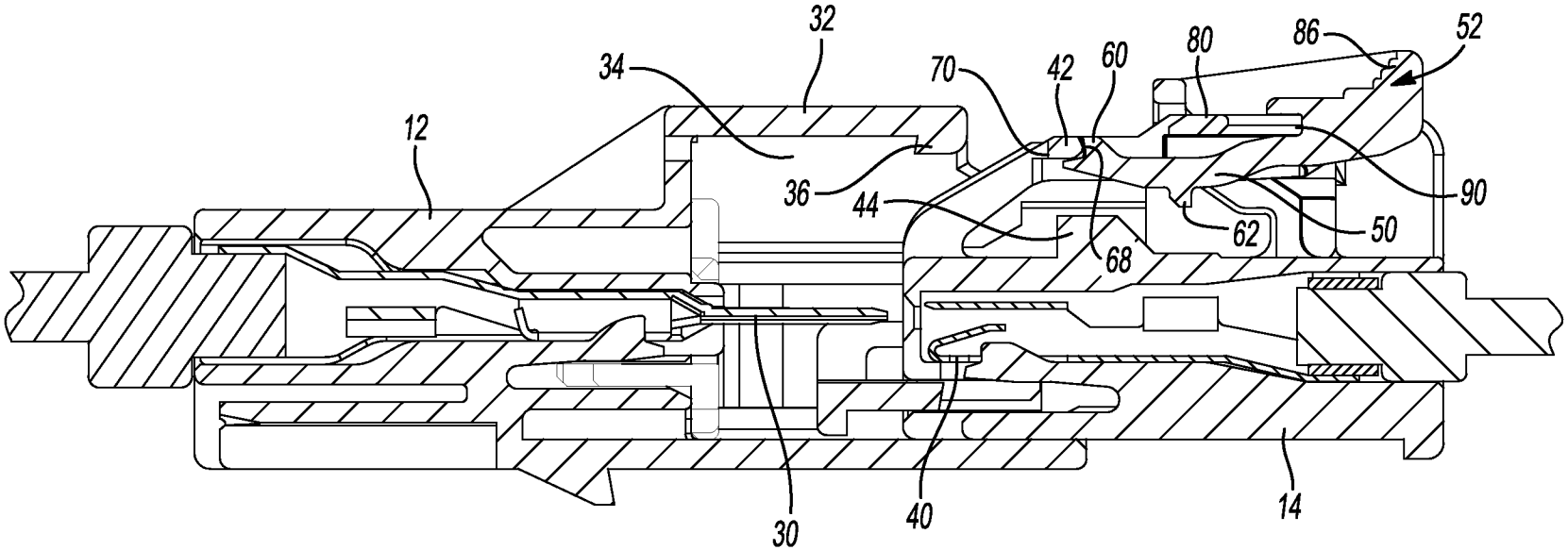
FIG. 3 is a section view taken longitudinally through the connector assembly of FIG. 1 illustrating the first and second connector parts in a partially mated or engaged condition and the connector position assurance structure in the first position.

With reference to FIG. 3, the first connector part 12 can be configured to house a first set of conductive terminals 30. The first connector part 12 can have a wall member 32 that can define a cavity 34 that is configured to receive a part of the second connector part 14. A control protrusion 36 can be coupled to the wall member 32 and can extend into the cavity 34.

Figure 4:
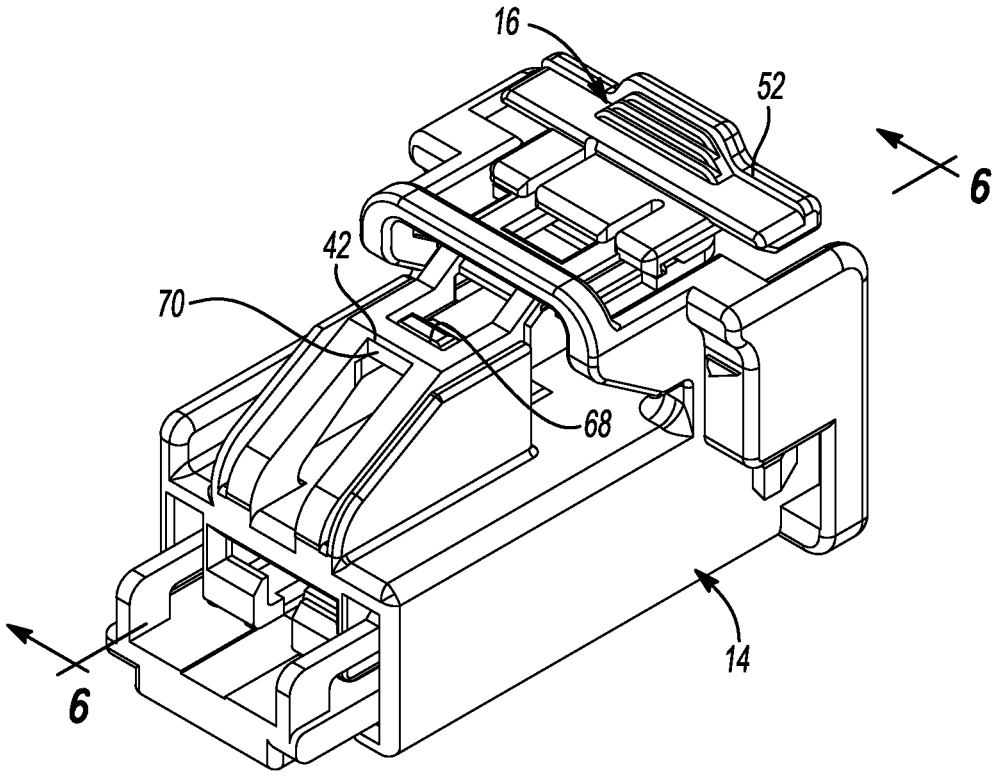
FIG. 4 is a perspective view of a portion of the connector assembly of FIG. 1, illustrating the second connector part and the connector position assurance structure in more detail, the connector position assurance structure being disposed in the first position.
Figure 5:
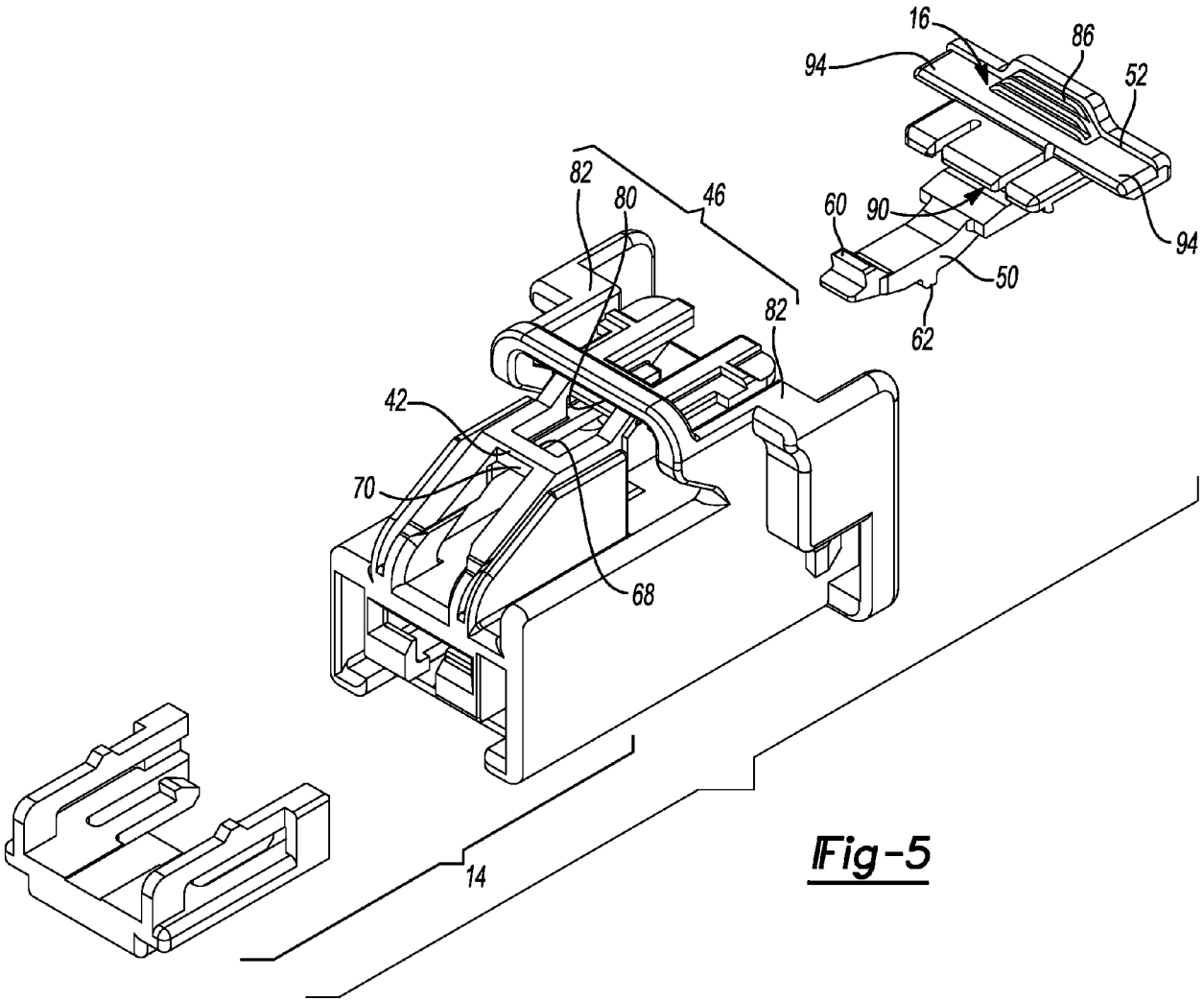
FIG. 5 is an exploded perspective view of a portion of the connector assembly of FIG. 1 illustrating the second connector part and the connector position assurance structure in more detail.

With reference to FIGS. 3 through 5, the second connector part 14 can be configured to house a second set of conductive terminals 40 that can be electrically coupled to the first set of conductive terminals 30 when the first and second connector parts 12 and 14 are engaged in the fully engaged position. The second connector part 14 can include a lock member 42, an anti-deflection protrusion 44, and a plurality of slider rails 46. The connector position assurance structure 16 can have a locking finger 50 and a slider 52 that can be fixedly coupled to the locking finger 50. The locking finger 50 can extend generally parallel to the axis 22 (FIG. 1) about which the connector position assurance structure 16 slides, and the slider 52 can be disposed generally perpendicular to the axis 22 (FIG. 1). The locking finger 50 can have a locking tab 60 and an anti-deflection tab 62. The locking tab 60 can be configured to abut a first side 68 of the lock member 42 on the second connector part 14 when the connector position assurance structure 16 is in the first position. The locking tab 60 can also be configured to abut a second, opposite side 70 of the lock member 42 on the second connector part 14 when the connector position assurance structure 16 is in the second position and the second connector part 14 is in the fully engaged position.

The control protrusion 36 on the first connector part 12 can contact the locking tab 60 when the second connector part 14 is in the fully engaged position and the connector position assurance structure 16 is in the first position. Such contact between the control protrusion 36 and the locking tab 60 can urge the locking tab 60 out of alignment with the lock member 42 so that the connector position assurance structure 16 can be moved along the axis 22 (FIG. 1) to the second position. It will be appreciated that absent the control protrusion's 36 movement of the locking tab 60 out of alignment with the lock member 42, sliding movement of the connector position assurance structure 16 from the first position toward the second position will be limited through contact between the locking tab 60 and the first side 68 of the lock member 42.

Figure 6:
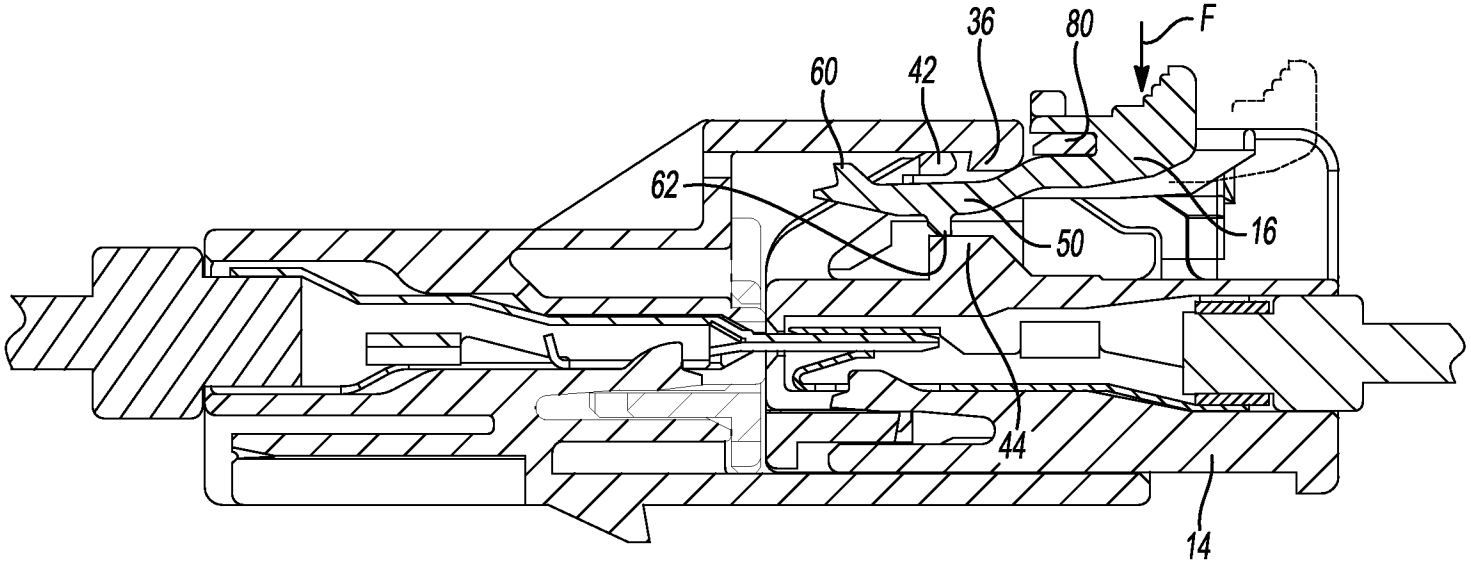
FIG. 6 is a section view similar to that of FIG. 3 but illustrating the first and second connector parts in the fully engaged position and the connector position assurance structure in the second position.

With reference to FIG. 6, the anti-deflection tab 62 can contact the anti-deflection protrusion 44 on the second connector part 14 when the connector position assurance structure 16 is in the second position and the second connector part 14 is in the fully engaged position to thereby inhibit disengagement of the locking tab 60 from the lock member 42 when the connector position assurance structure 16 is in the second position. When assembled in this manner, the locking finger 50 can be spaced apart from the control protrusion 36 (i.e., when the connector position assurance structure 16 is in the second position and the second connector part 14 is in the fully engaged position) to permit the control protrusion 36 to fully seat against the lock member 42. In this regard, it will be appreciated that the locking finger 50 does not contact the control protrusion 36 and therefore cannot urge the control protrusion 36 away from the lock member 42.

With reference to FIGS. 2, 3 and 5, the slider 52 can be configured to engage the plurality of slider rails 46 on the second connector part 14 when the connector position assurance structure 16 is in the second position and the second connector part 14 is in the fully engaged position. The plurality of slider rails 46 can be configured to inhibit deflection of the connector position assurance structure 16 so that the connector position assurance structure 16 cannot be deflected to a point where the connector position assurance structure 16 disengages the second side 70 of the lock member 42 solely due to application of a force to the slider 52 that urges the slider 52 against the plurality of slide rails 46 (i.e., a downwardly directed force F as shown in FIG. 6). The slider 52 can be configured to disengage the plurality of slider rails 46 on the second connector part 14 when the connector position assurance structure 16 is moved from the second position toward the first position by an amount that permits the locking tab 60 to disengage the lock member 42.

In the particular example provided, the plurality of slide rails 46 comprises a central rail 80 and a pair of lateral side rails 82, and the slider 52 also includes a slider input member 86 that is configured to receive a manual input (e.g., from the finger of a technician) to push the slider 52 between the first and second positions. The slider input member 86 can be disposed in any desired location relative to the plurality of slide rails 46, but in the particular example provided, the slider input member 86 is disposed laterally between the pair of lateral side rails 82. The central rail 80 can be disposed generally in-line with the locking finger 50 and can be received into a pocket 90 that can be formed into the connector position assurance structure 16 when the connector position assurance structure 16 is in the second position. The pair of lateral side rails 82 can support opposite lateral sides 94 of the slider 52.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A connector assembly comprising:

a first connector part configured to house a first set of terminals, the first connector part having a control protrusion;

a second connector part configured to house a second set of terminals, the second connector part being configured to engage the first connector part in a fully engaged position in which the first and second sets of terminals are engaged to one another, the second connector part having a lock member and at least one slider rail; and a connector position assurance structure slidably mounted on the second connector part, the connector position assurance structure being movable from a first position to a second position only when the second connector part is in the fully engaged position to thereby inhibit uncoupling of the first and second connector parts;

wherein the connector position assurance structure has a locking finger and a slider that is fixedly coupled to the locking finger, the locking finger having a locking tab and an anti-deflection tab, the locking tab being configured to abut a first side of the lock member on the second connector part when the connector position assurance structure is in the first position, the locking tab being configured to abut a second, opposite side of the lock member on the second connector part when the connector position assurance structure is in the second position and the second connector part is in the fully engaged position, the control protrusion contacting the locking tab when the second connector part is in the fully engaged position and the connector position assurance structure is in the first position to urge the locking tab out of alignment with the lock member so that the connector position assurance structure can be moved to the second position, the anti-deflection tab contacting an anti-deflection protrusion on the second connector part when the connector position assurance structure is in the second position and the second connector part is in the fully engaged position to thereby inhibit disengagement of the locking tab from the lock member when the connector position assurance structure is in the second position, wherein the locking finger is spaced apart from the control protrusion when the connector position assurance structure is in the second position and the second connector part is in the fully engaged position to permit the control protrusion to fully seat against the lock member;

wherein the slider engages the slider rail to inhibit deflection of the slider when the connector position assurance structure is in the second position, the slider being configured to disengage the slider rail to permit deflection of the slider an amount that permits the lock member to disengage the control protrusion when the connector position assurance structure is in the first position.

2. The connector assembly of claim 1, wherein the second connector part includes a plurality of the slider rails and the slider engages the plurality of slider rails on the second connector part when the conector position assurance structure is in the second position and the second connector part is in the fully engaged position, the slider being configured to disengage the plurality of slider rails on the second connector part when the connector position assurance structure is moved from the second position toward the first position by an amount that permits the locking tab to disengage the lock member.

3. The connector assembly of claim 2, wherein the slider includes a slider input member that is adapted to receive a manual input to push the slider between the first and second positions.

4. The connector assembly of claim 3, wherein the plurality of slider rails comprises a pair of side rails that support opposite lateral sides of the slider.

5. The connector assembly of claim 4, wherein the slider input is disposed laterally between the side rails.

6. The connector assembly of claim 3, wherein the plurality of slider rails comprises a central rail that is received into a pocket that is formed into the connector position assurance structure when the connector position assurance structure is in the second position.

7. The connector assembly of claim 2, wherein the locking finger extends along an axis about which the connector position assurance structure slides and wherein the slider is disposed generally perpendicular to the axis.

8. A connector assembly comprising:

a first set of terminals;

a first connector part housing the first set of terminals, the first connector part having a control protrusion;

a second set of terminals;

a second connector part housing the second set of terminals, the second connector part being configured to engage the first connector part in a fully engaged position in which the first and second sets of terminals are engaged to one another, the second connector part having a lock member and at least one slider rail; and a connector position assurance structure slidably mounted on the second connector part, the connector position assurance structure being movable from a first position to a second position only when the second connector part is in the fully engaged position to thereby inhibit uncoupling of the first and second connector parts;

wherein the connector position assurance structure has a locking finger and a slider that is fixedly coupled to the locking finger, the locking finger having a locking tab and an anti-deflection tab, the locking tab being configured to abut a first side of the lock member on the second connector part when the connector position assurance structure is in the first position, the locking tab being configured to abut a second, opposite side of the lock member on the second connector part when the connector position assurance structure is in the second position and the second connector part is in the fully engaged position, the control protrusion contacting the locking tab when the second connector part is in the fully engaged position and the connector position assurance structure is in the first position to urge the locking tab out of alignment with the lock member so that the connector position assurance structure can be moved to the second position, the anti-deflection tab contacting an anti-deflection protrusion on the second connector part when the connector position assurance structure is in the second position and the second connector part is in the fully engaged position to thereby inhibit disengagement of the locking tab from the lock member when the connector position assurance structure is in the second position, wherein the locking finger is spaced apart from the control protrusion when the connector position assurance structure is in the second position and the second connector part is in the fully engaged position to permit the control protrusion to fully seat against the lock member;

wherein the slider engages the slider rail to inhibit deflection of the slider when the connector position assurance structure is in the second position, the slider being configured to disengage the slider rail to permit deflection of the slider an amount that permits the lock member to disengage the control protrusion when the connector position assurance structure is in the first position.

9. The connector assembly of claim 8, wherein the second connector part includes a plurality of the slider rails and the slider engages the plurality of slider rails on the second connector part when the connector position assurance structure is in the second position and the second connector part is in the fully engaged position, the slider being configured to disengage the plurality of slider rails on the second connector part when the connector position assurance structure is moved from the second position toward the first position by an amount that permits the locking tab to disengage the lock member.

10. The connector assembly of claim 9, wherein the slider includes a slider input member that is adapted to receive a manual input to push the slider between the first and second positions.

11. The connector assembly of claim 10, wherein the plurality of slider rails comprises a pair of side rails that support opposite lateral sides of the slider.

12. The connector assembly of claim 11, wherein the slider input is disposed laterally between the side rails.

13. The connector assembly of claim 10, wherein the plurality of slider rails comprises a central rail that is received into a pocket that is formed into the connector position assurance structure when the connector position assurance structure is in the second position.

14. The connector assembly of claim 9, wherein the locking finger extends along an axis about which the connector assurance position structure slides and wherein the slider is disposed generally perpendicular to the axis.

15. A connector assembly comprising:

first and second connector parts that are configured to engage one another in a fully engaged position; and a connector position assurance structure slidably mounted on the second connector part for movement between a first position and a second position, the connector position assurance structure being movable from the first position to the second position when the first and second connector parts engage one another in the fully engaged position, the connector position assurance structure being configured to contact a first side of a lock member on the second connector part to thereby inhibit movement of the connector position assurance structure from the first position to the second position when the first and second connector parts are not engaged to one another in the fully engaged position, the connector position assurance structure being configured to contact a second side of the lock member to inhibit the connector position assurance structure from being moved from the second position to the first position;

wherein the first connector part has a control protrusion that is configured to push the connector position assurance structure away from the lock member so that the connector position assurance structure can be moved from the first position to the second position when the first and second connector parts are engaged to one another in the fully engaged position;

wherein the control protrusion is disposed against the first side of the lock member when the connector position assurance structure is in the second position and the first and second connector parts are engaged to one another in the fully engaged position; and wherein the connector position assurance structure does not contact the control protrusion when the connector position assurance structure is in the second position and the first and second connector parts are engaged to one another in the fully engaged position;

wherein the connector position assurance structure has a slider that engages at least one slider rail on the second connector part to inhibit deflection of the slider when the connector position assurance structure is in the second position, the slider being configured to disengage the slider rail to permit deflection of the slider an amount that permits the lock member to disengage the control protrusion when the connector position assurance structure is in the first position.

16. The connector assembly of claim 15, wherein the slider engages a plurality of the slider rails when the connector position assurance structure is in the second position, the plurality of slider rails being configured to inhibit deflection of the connector position assurance structure so that the connector position assurance structure cannot be deflected to a point where the first and second connector parts can be disengaged from one another while the connector position assurance structure is in the second position.

* * * * *